US005986683A

United States Patent [19]

Sawano et al.

[11] Patent Number: 5,986,683

[45] **Date of Patent: *Nov. 16, 1999**

[54] CLEANING ROLLER SYSTEM AND OPERATING METHOD THEREOF

[75] Inventors: Mitsuru Sawano; Kazuaki Kinjyo, both of Shizouka-ken; Masatoshi Toda; Tetsuya Murase, both of Chiba, all of Japan

[73] Assignees: Fuji Photo Film., Ltd., Kanagawa; Seiko Instruments Information Device Inc., Chiba, both of Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/883,433

[22] Filed: Jun. 26, 1997

[30] Foreign Application Priority Data

Jun. 28, 1996 [JP] Japan ..... 8-169805

[51] Int. Cl.[6] ..... B41J 29/17; B41J 35/00

[52] U.S. Cl. ..... 347/171; 400/701

[58] Field of Search ..... 400/701; 347/171

[56] References Cited

FOREIGN PATENT DOCUMENTS

| | | | |
|---|---|---|---|
| 2-145376 | 6/1990 | Japan . | |
| 2-145377 | 6/1990 | Japan . | |
| 3-166982 | 7/1991 | Japan | B41J 35/00 |
| 4-221670 | 8/1992 | Japan | B41J 32/00 |
| 5-169696 | 7/1993 | Japan . | |
| 7-117359 | 5/1995 | Japan | B41M 5/30 |
| 7-132678 | 5/1995 | Japan | B41M 5/26 |
| 9-39348 | 2/1997 | Japan | B41J 35/00 |

*Primary Examiner*—Huan Tran
*Attorney, Agent, or Firm*—Sughrue, Mion, Macpeak & Seas, PLLC

[57] ABSTRACT

A cleaning roller system, which is preferable for use in a printer having a printing head, is disclosed. The cleaning roller system comprises an adhesive roller which is provided on a recording material feeding side relative to a print head, the adhesive roller has adhesive property, and is in contact with a surface of said recording material, and rotates in a direction of transporting said recording material.

15 Claims, 7 Drawing Sheets

CLEANING ROLLER SYSTEM AND OPERATING METHOD THEREOF

BACKGROUND OF THE INVENTION

1. Field of the Invention

This invention relates to a cleaning roller system preferable for use in a printer having a printing head (thermal head) and an operating method thereof.

2. Description of the Related Art

Some of thermal head type printers utilize a thermal transfer type ribbon (toner ribbon) as recording material. As shown in FIG. 7, for example, this type of printer comprises a thermal head 1, a platen 5 disposed so as to oppose a resistive heating element 3 on the thermal head 1, a toner ribbon 7 to be interposed between the thermal head 1 and the platen 5 and to be wound up from a feeding side 7*a* to a winding side 7*b*, a guide roller 9 for guiding the toner ribbon 7 and a pair of pinch rollers 11 at an exit from the thermal head 1 and the platen 5. A recording sheet 13 is overlapped with the toner ribbon 7 and inserted between the thermal head 1 and the platen 5. Then, dots in the resistive heating element corresponding to an image to be printed are selectively heated so as to perform thermal transfer from the toner ribbon 7, so that the image is transferred to an image receiving plane of the recording sheet 13.

Further, some of thermal head type printers transfer an image directly to a heat sensitive film which is a recording material without use of the toner ribbon 7. This type of printer, as shown in FIG. 8 for example, comprises a thermal head 1, a platen 5 disposed so as to oppose the resistive heating element 3 of the thermal head 1, and a pair of pinch rollers 11 disposed at an exit from the thermal head 1 and the platen 5. A heat sensitive film 15 which is a recording material is inserted between the thermal head 1 and the platen 5. Then, dots in the resistive heating element corresponding to an image to be printed are selectively heated so as to produce colors directly on the heat sensitive film 15 thereby obtaining the image.

In the conventional printers shown in FIGS. 7 and 8, the toner ribbon 7 or the heat sensitive film 15 is fed with being interposed between the thermal head 1 and the platen 5 and then a desired image is obtained on the recording sheet 13 or the heat sensitive film 15.

However, because the resistive heating element 3 of the thermal head 1 keeps in contact with a recording material upon transferring heat, if a foreign matter adheres to the recording material before it reaches the resistive heating element 3, the foreign matter carried with transportation of the recording material is caught by the resistive heating element 3. Contact between the resistive heating element 3 and the recording material is lost at that position so that black portion (i.e. line void) may be generated where the foreign matter passes in the recording material because thermal transfer is not realized there.

SUMMARY OF THE INVENTION

The present invention has been proposed to solve the above mentioned problem. Accordingly, an object of the present invention is to provide a cleaning roller system capable of preventing generation of line void which may be produced by catching a foreign matter, and an operating method thereof, thereby achieving improvement of the quality of image.

According to one aspect of the present invention, there is provided a cleaning roller system comprising an adhesive roller which is provided on a recording material feeding side relative to a print head and in contact with a surface of the recording material and rotates in a direction of transporting the recording material.

According to another aspect of the present invention, there is provided an operating method for a cleaning roller system which comprises adhesive rollers in contact with a surface of a recording material on a feeding side for the recording material relative to a print head, the operating method comprising the steps of: winding back the recording material until a portion of the recording material opposing a print head passes the adhesive rollers prior to start of a print, winding up the recording material by an amount at least larger than that of winding back, and starting print with the print head in contact with the recording material.

In the cleaning roller having such a construction, at the time of print, the adhesive rollers rotate in contact with the recording material and when foreign matter adhering to the recording material passes the adhesive rollers, it is absorbed by the adhesive rollers and removed from a surface of the recording material. Thus, the recording material which has passed the adhesive rollers comes into contact with the print head with its cleaned surface. Thus, no foreign matter is caught by the print head.

Further, according to the operating method for the cleaning roller, in state in which the print head is separated from the recording material, a portion of the recording material which is located at the printing head prior to print is wound back up to a position beyond the adhesive roller and then the recording material is wound up by larger amount than that of winding-back. Consequently, a recording material between the printing head and the adhesive roller is made to pass over the adhesive roller so that foreign matter adhering to the recording material between the printing head and the adhesive roller is removed.

BRIEF DESCRIPTION OF THE DRAWINGS

The foregoing and other objects and advantages of the invention will become more clear with reference to following detailed description with accompanied drawings.

DETAILED DESCRIPTION OF THE PREFERRED EMBODIMENTS

Hereinafter preferred embodiments of a cleaning roller and its operating method according to the present invention will be described in detail with reference to the accompanied drawings.

Figure 1:
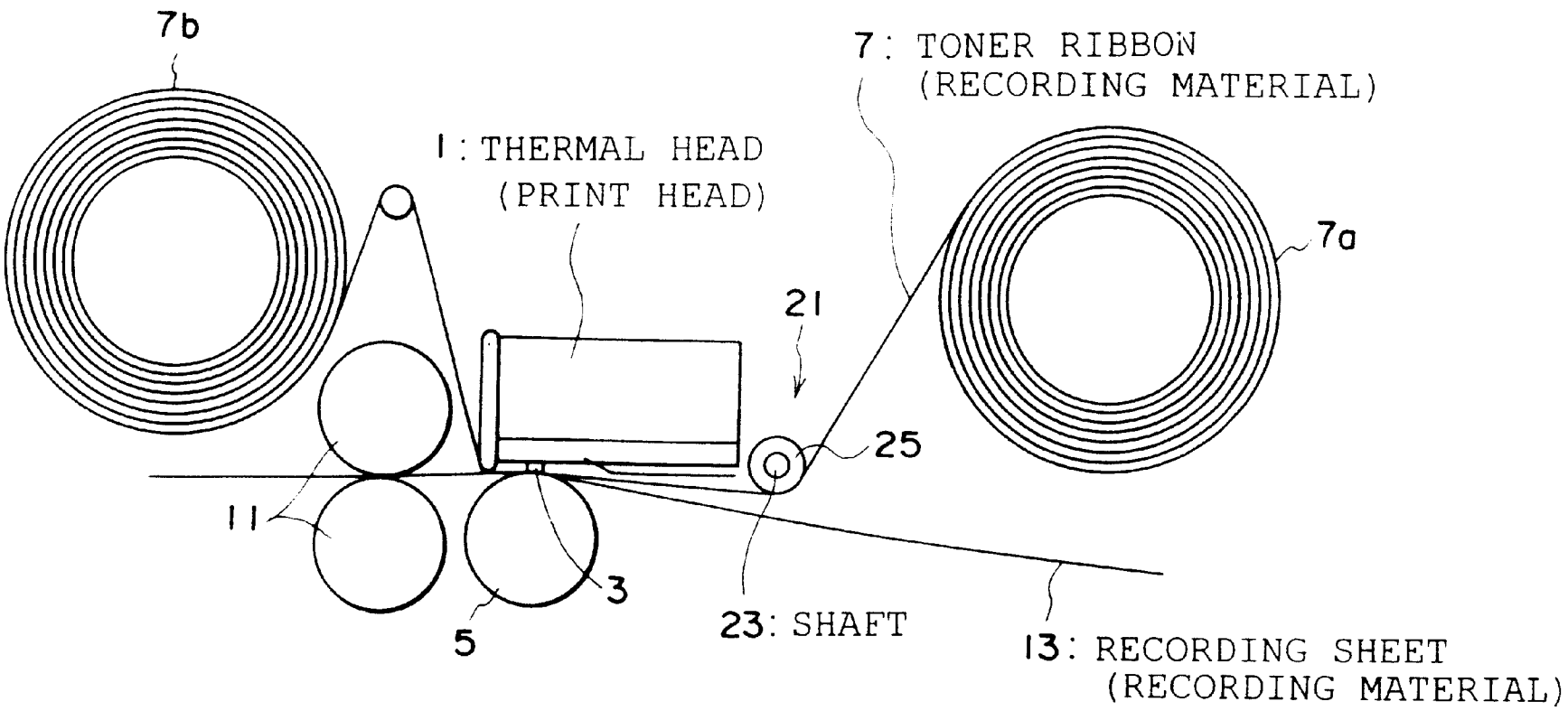
FIG. 1 is a schematic view showing a first embodiment of the cleaning roller according to the present invention.
Figure 2A:
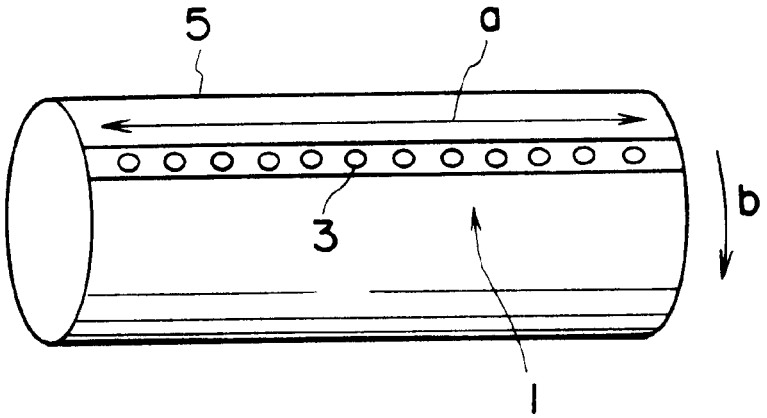
FIGS. 2A and 2B are schematic views showing thermal head types.
Figure 2B:
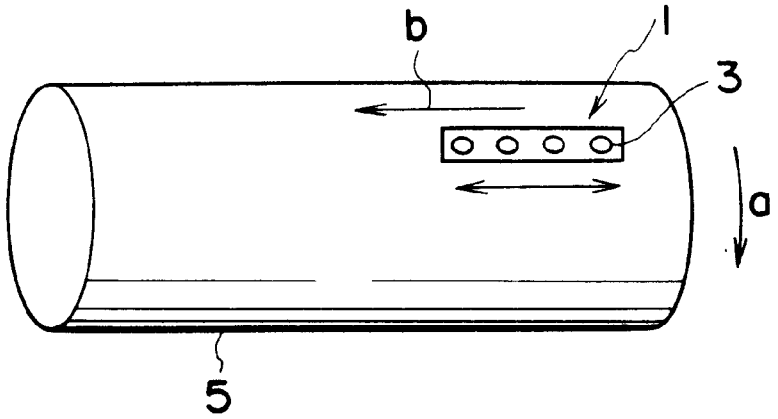

FIG. 1 is a schematic structure showing a first embodiment of a cleaning roller according to the present invention, and FIGS. 2A and 2B are schematic views showing thermal head types. A printer comprises a thermal head 1, a platen 5 disposed so as to oppose a resistive heating element 3 of this thermal head 1, a toner ribbon to be interposed between the thermal head 1 and the platen 5 and to be wound up from a feeding side 7*a* to a winding side 7*b* and a pair of pinch rollers 11 disposed at an exit from the thermal head 1 and platen 5 which oppose each other.

The thermal head 1 can be classified into line head type as shown in FIG. 2A and serial head type as shown in FIG. 2B. Any type of these may be utilized in the present invention. In the line head type, resistive heating elements 3 are arranged in line from one end of the platen 5 to the other end thereof along the rotation axis of the platen 5. The direction of the rotation axis of the platen is main scanning direction a for printing operation and a rotation direction of the platen 5 is sub-scanning direction b for printing operation. The serial head type has a thermal head 1 in which the resistive heating elements 3 are arranged in line in a shorter interval than a length of the platen 5. In this case, the direction of the platen rotation axis is sub-scanning direction b for printing operation and a rotation direction of the platen 5 is main scanning direction a for printing operation. In an embodiment described below, an example in which the thermal head 1 is of the line head type will be explained.

An adhesive guide roller 21 which is a cleaning roller is disposed between the feeding side 7*a* for the toner ribbon 7 and the thermal head 1 and the adhesive guide roller 21 is in contact with a thermal head opposing surface of the toner ribbon 7. The adhesive guide roller 21 may be type A guide roller in which an adhesive layer 25 made of rubber material is provided on an external circumference of a rotation shaft 23 or type B adhesive guide roller in which double-sided adhesive tape is attached to the external circumference of the rotation shaft 23.

When the toner ribbon 7 is fed from the feeding side 7*a* to the winding side 7*b*, the adhesive guide roller 21 rotates with the adhesive layer 25 in contact with the thermal head opposing surface of the toner ribbon 7. This adhesive guide roller 21 also serves as a guide roller for disposing the toner ribbon 7 in a predetermined path.

In the cleaning roller having such a construction, at the time of printing, the adhesive guide roller 21 rotates in contact with the thermal head opposing surface and if a foreign matter adhering to the toner ribbon 7 passes the adhesive guide roller 21, it is absorbed by the adhesive layer 25 of the adhesive guide roller 21 so as to remove the foreign matter from the surface of the toner ribbon 7. Thus, the toner ribbon 7 after passing the adhesive guide roller 21 contacts the resistive heating element 3 with its thermal head opposing surface being cleaned. Consequently, any foreign matter is not caught by the resistive heating element 3 so that the resistive heating element 3 always makes contact with the toner ribbon 7 with a favorable contact condition.

As described above, in the above cleaning roller, the adhesive guide roller 21 is disposed between the thermal head 1 and the feeding side for the toner ribbon 7 and any foreign matter adhering to the toner ribbon 7 is absorbed and removed by the adhesive layer 25 of this adhesive guide roller 21. Thus, the thermal head opposing surface of the toner ribbon 7 to be fed to the thermal head 1 can be always clean thereby preventing generation of line void which occurs because the foreign matter is caught by the resistive heating element 3.

Figure 3:
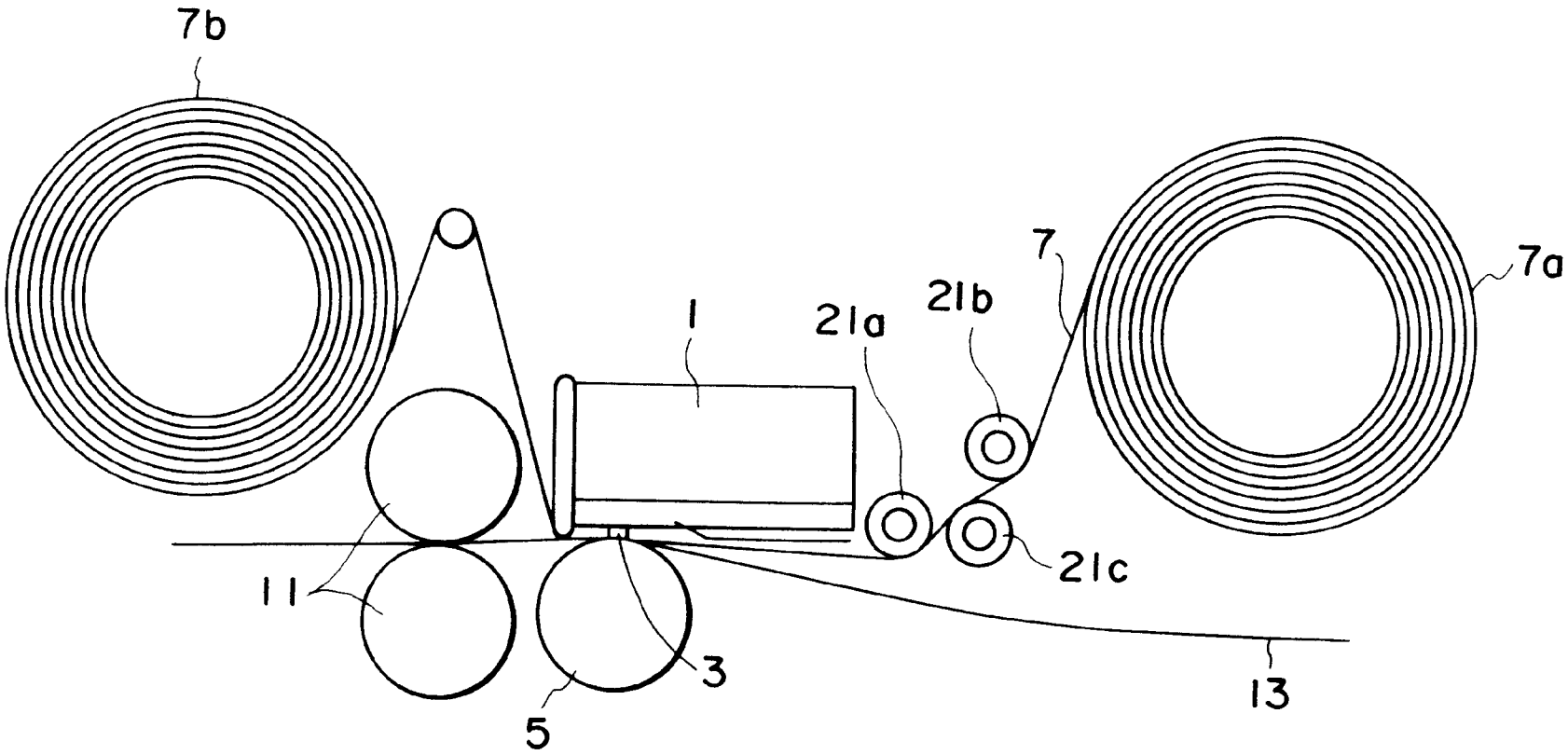
FIG. 3 is a schematic view showing a second embodiment of the cleaning roller according to the present invention.

Next, a second embodiment of the cleaning roller according to the present invention will be described with reference to FIG. 3. FIG. 3 is a schematic construction showing the second embodiment of the cleaning roller according to the present invention. The printer according to this embodiment is same as that according to the first embodiment. On the other hand, the cleaning roller comprises first, second and third adhesive guide rollers 21*a*, 21*b*, and 21*c*. The first and second guide rollers 21*a*, 21*b* are located between the feeding side 7*a* of the toner ribbon 7 and the thermal head 1 and in contact with the thermal head opposing surface of the toner ribbon 7. The third adhesive guide roller 21*c* is disposed at a side opposite to the first and second guide rollers 21*a* and 21*b* across the toner ribbon 7.

Thus, the first and second guide rollers 21*a* and 21*b* are in contact with the thermal head opposing surface of the toner ribbon 7 and the third adhesive guide roller 21*c* is in contact with the recording sheet opposing surface of the toner ribbon 7.

In the cleaning roller according to the second embodiment, like the above-mentioned first embodiment, a foreign matter adhering to the thermal head opposing surface of the toner ribbon 7 can be removed and further a foreign matter adhering to the recording sheet opposing surface of the toner ribbon 7 can be also removed by the third adhesive guide roller 21*c*.

Thus, because foreign matters on both sides of the toner ribbon 7 can be removed so as to reduce an amount of floating foreign matters in the vicinity of the head, it is possible to further reduce a percentage of generation of line void which occurs because the foreign matter is caught by the resistive heating element 3.

Figure 4:
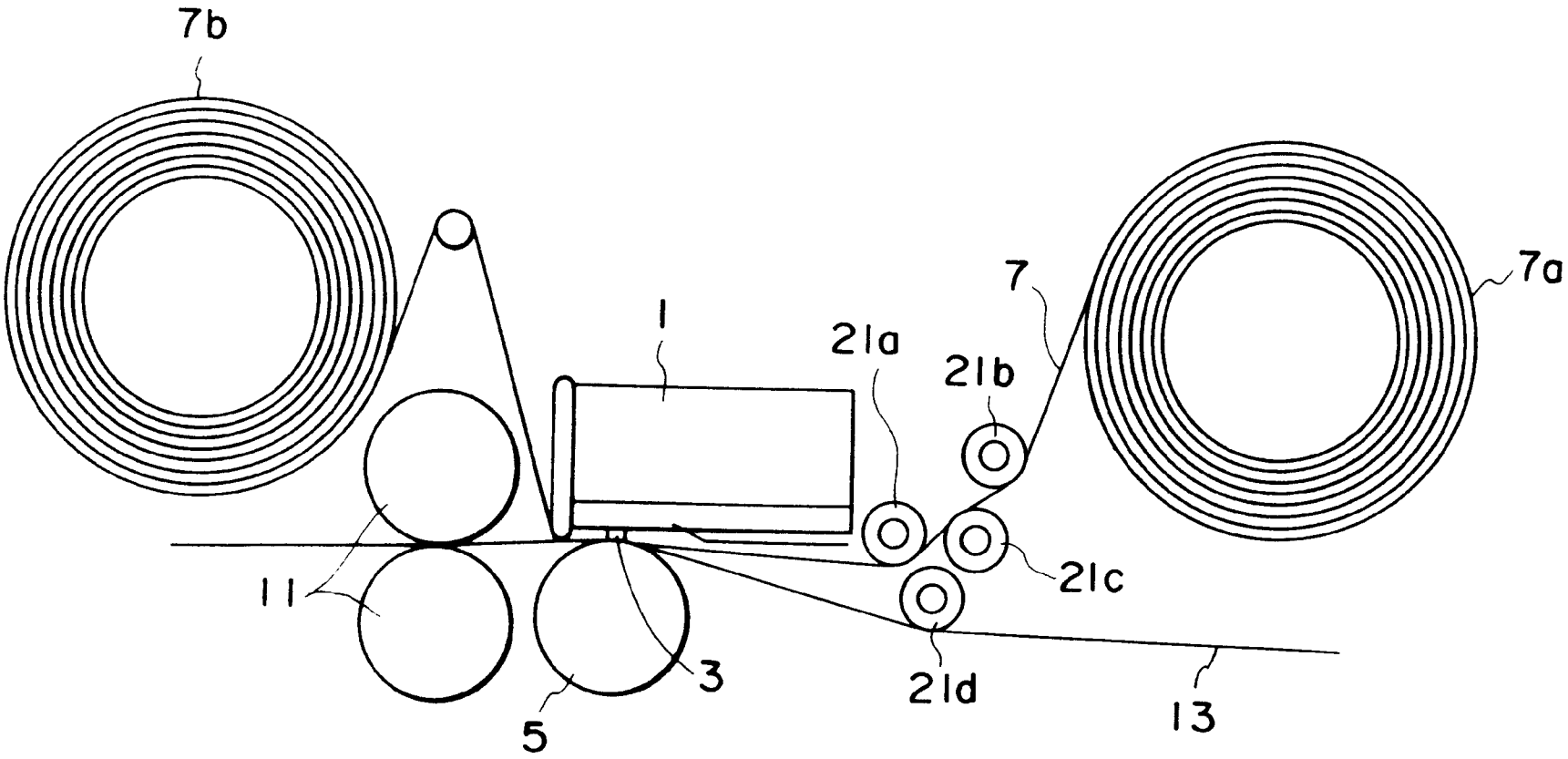
FIG. 4 is a schematic view showing a third embodiment of the cleaning roller according to the present invention.

Next, a third embodiment of the cleaning roller according to the present invention will be described with reference to FIG. 4. FIG. 4 is a schematic construction showing the third embodiment of the cleaning roller according to the present invention. The printer in this embodiment has same construction as the second embodiment. On the other hand, with respect to the cleaning roller, in addition to the first, second and third adhesive guide rollers 21*a*, 21*b*, and 21*c* according to the above second embodiment, further a fourth adhesive guide roller 21*d* is provided. The fourth adhesive guide roller 21*d* is disposed on a feeding side for the recording sheet 13 relative to the thermal head 1 and in contact with a toner ribbon opposing surface of the recording sheet 13.

According to the cleaning roller of the third embodiment, not only foreign matter on both sides of the toner ribbon can be removed but also foreign matter on the toner ribbon opposing surface of the recording sheet 13 can be removed. That is, foreign matter on all surfaces (both surfaces of the toner ribbon 7 and toner ribbon opposing surface of the recording sheet 13) which lowers a contacting performance of the resistive heating element 3 can be removed.

Figure 5:
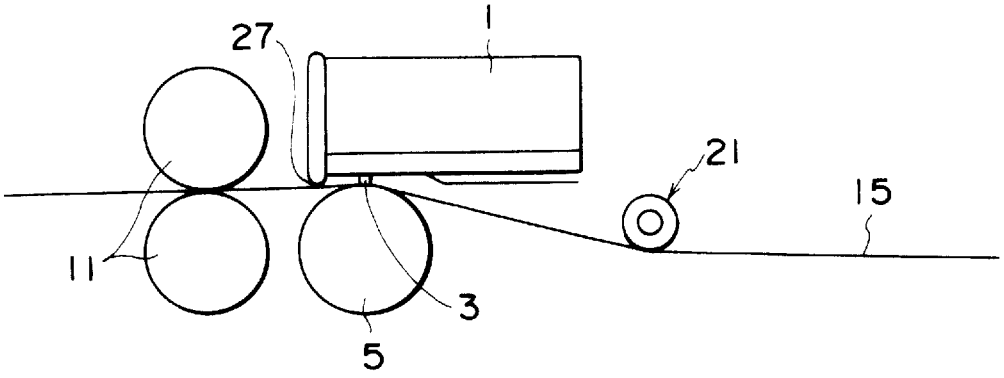
FIG. 5 is a schematic view showing a fourth embodiment of the cleaning roller according to the present invention.

Next, a fourth embodiment of the cleaning roller according to the present invention will be described with reference to FIG. 5. FIG. 5 is a schematic construction showing the fourth embodiment of the cleaning roller according to the present invention. A printer in this embodiment comprises the thermal head 1, the platen 5 and a pair of the pinch rollers 11. This does not use the toner ribbon 7 but a heat sensitive film 15 in which colors are produced by the resistive heating element 3.

The adhesive guide roller 21 which is a cleaning roller is disposed on a paper feeding side relative to the thermal head 1 and the adhesive layer 25 on the external circumference of the adhesive guide roller 21 is made to contact the thermal head opposing surface of the heat sensitive film 15.

In the cleaning roller according to the fourth embodiment, foreign matter adhering to the thermal head opposing surface of the heat sensitive film 15 can be absorbed and removed by the adhesive layer 25 of the adhesive guide roller 21 so as to keep the thermal head opposing surface of the heat sensitive film 15 to be fed to the thermal head 1 always clean. Consequently, it is possible to securely prevent generation of line void which occurs because foreign matter is caught by the resistive heating element 3.

In any case of the above first, second, third and fourth embodiments, it is preferable that the cleaning roller is disposed in the vicinity of the thermal head 1, because the cleaning roller is disposed to remove foreign matter adhering to the toner ribbon 7 or the heat sensitive film 15 before it reaches the thermal head 1. The shorter distance to the thermal head 1 is set, the lower a probability of foreign matter's adhering to the toner ribbon or the heat sensitive film after it passes the cleaning roller becomes.

EXAMPLES

Cleaning rollers according to the above first, second, third and fourth embodiments were actually produced and percentages of generation of line void were compared between a printer with those cleaning rollers and a printer having a conventional construction.

In the adhesive guide roller 21 of the type A, its rotation shaft 23 was produced with ø7 mm stainless steel and its adhesive layer was formed with Mimoza UnderLT manufactured by Miyakawa Roller so as to have a thickness of 0.5 mm (thickness after polishing).

Adhesion of the adhesive layer 25 was 10 g/cm$^2$ (measured according to a method equivalent to that mentioned in "Test in Peeling A Specimen in which Two Parallel Metallic Plates were Bonded by Rubber" in JIS K-630 "Bonding Test of Metal and Vulcanized Rubber".)

In the adhesive guide roller 21 of the type B, its rotation shaft was produced with ø8 mm stainless steel. As the adhesive layer 25, Scotch transparent double-sided adhesive tape 665-3 manufactured by Sumitomo 3M (approximately 0.1 mm in thickness) was bonded and its adhesion was adjusted to about 150 g/cm$^2$.

As the recording material for the toner ribbon 7, respective color materials (Y, M, C, and K) used in thermosensible transfer recording material described in Japanese Patent Application Laid-Open No. 7-117359 were employed. Amide stearate of 0.24 g and n-propyl alcohol of 60 g were added to fluid dispersion of 10 g containing four kinds of color materials A–D mentioned below to obtain application liquids. Those application liquids were coated on polyester films (made by Teijin) of 5 μm in thickness the rear surface of which had been subjected to peeling treatment so that dry thin films A–D were 0.36 μm, 0.38 μm, 0.42 μm, and 0.40 μm so as to produce thermosensible transfer materials.

| | | | |
|---|---|---|---|
| A: cyan pigment (CI, P. B. 15:4) | 12 g | — | — |
| B: magenta pigment (CI, P. R. 57:1) | — | 12 g | — |
| C: yellow pigment (CP, P. Y. 14) | — | — | 12 g |
| D: carbon (MA-100 manufactured by Mitsubishi Chemical Corp.) | | 12 g | |
| Butyral (Eslex FPD-1 manufactured by Sekisui Chemical Co., Ltd., softening point 70° C., average polymerization degree 300 or less) | | 12.0 g | |
| Solvent: n-propyl alcohol (n-PrOH) | | 110.4 g | |
| Dispersion assistant agent: Solsparce S-20000 (made by ICI Japan) | | 0.8 g | |

For the recording sheet 13, an image receiving material disclosed in Japanese Patent Application Laid-Open (JP-A) No. 7-132678 was utilized, more particularly the image receiving material in which cushioning layer of following composition was coated in thickness of 20 μm on a supporting substance of 75 μm composed of Clisper G2323 white PET manufactured by Toyobo Co., Ltd. and further an image receiving layer of following composition was coated in thickness of 1 μm was utilized.

| [Cushioning layer] | weight % |
|---|---|
| Polymer: Ethylene-ethylene acrylate copolymer (Ebaflex A-709, manufactured by Mitsui Petrochemical Industries, Ltd.) | 20 |
| Fluoric surfactant (Megafuck F177P, Dainippon Ink & Chemicals, Inc.) | 0.1 |
| Solvent | 100 |

| [Image receiving layer] | Parts by weight |
|---|---|
| Nylon | 2 |
| Butyral | 9 |
| Fluoric surfactant 10% propyl alcohol | 1.5 |
| n-propyl alcohol | 58 |
| MFG-AC (acetate) | 14 |

For the heat sensitive film 15, transparent heat sensitive film TRM manufactured by Fuji Photo Film Co., Ltd. was employed.

For measurement of a percentage of generation of line void, using four colors (KCMY) ribbons and the recording sheet 13, four color tints of 40% dots were printed in overlapping.

This procedure was repeated for 100 pieces and a quantity of conceivable density dropping portions in the sub-scanning direction were counted. Then, this count was identified as a number of occurrences of line void and (a number of occurrences of line void/100 pieces)×100% was defined as a percentage of generation of line void.

To remove foreign matter in the interval between the thermal head 1 and the cleaning roller, sequence winding operation for winding back the toner ribbon 7 and the heat sensitive film 15 by a predetermined amount was carried out.

Figure 6A:
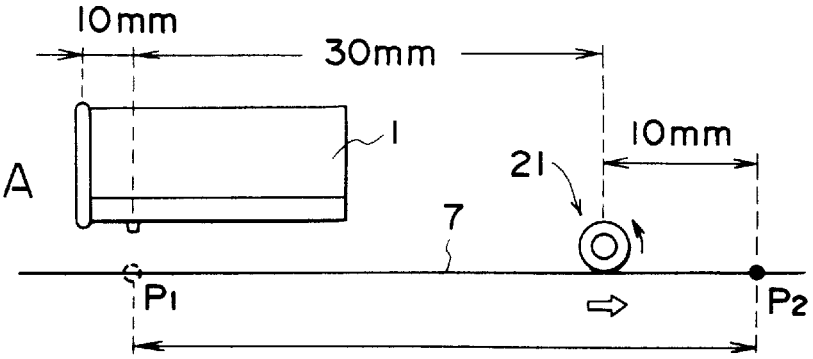
FIGS. 6A through 6C are schematic views for showing a winding-back operation of the cleaning roller.
Figure 6B:
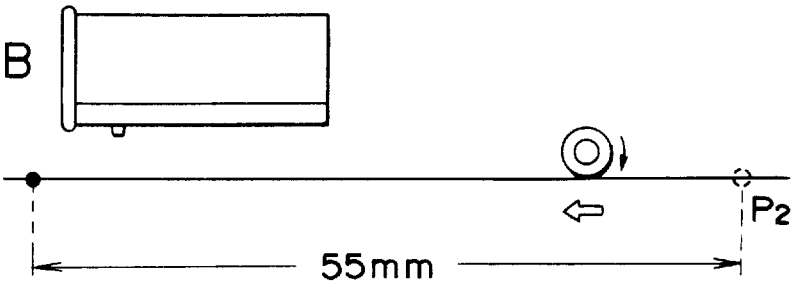
Figure 6C:
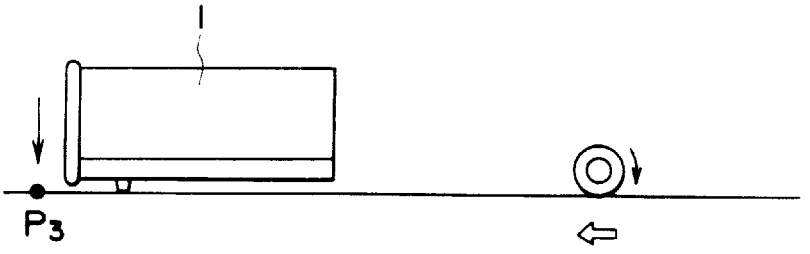

As for this winding-back operation, with the thermal head 1 separated from the platen 5 prior to print, a ribbon portion located at the position $P_1$ of the thermal head 1 as shown in FIG. 6A was wound back up to the position $P_2$ which was 10 mm past the adhesive guide roller 21. Then, as shown in FIG. 6B, the toner ribbon 7 of 55 mm was wound up so as to bring the position $P_2$ to a position $P_3$. Then, as shown in FIG. 6C, the thermal head 1 was made to contact the toner ribbon 7 and the toner ribbon 7 and the recording sheet 13 were transported at the same speed to start a print.

In this embodiment, to avoid attachment of foreign matter on a peel bar 27, the winding-back mentioned in FIG. 6B was continued until the point $P_2$ passed the peel bar ahead of the head.

In a case in which the winding-back operation was performed, the thermal head 1 was made to contact the toner ribbon 7 before the print was started and then the recording sheet 13 was transported at the same speed as that for winding back the toner ribbon 7.

A percentage of generation of line void obtained from the above condition is shown in Table 1.

TABLE 1

| Construction | Adhesive roller | Sequence | Percentage of generation of line void |
|---|---|---|---|
| Conventional construction 1 | None | Winding back is not done | 80% |
| Embodiment 1 | A | Winding back is not done | 15% |
| Embodiment 2 | A | Winding back is not done | 10% |
| Embodiment 3 | A | Winding back is not done | 5% |
| Embodiment 1 | A | Winding back is done | 5% |
| Embodiment 2 | A | Winding back is done | 2% |
| Embodiment 3 | A | Winding back is done | 1% |
| Conventional construction 2 | None | Winding back is not done | 10% |
| Embodiment 4 | A | Winding back is not done | 1% |
| Embodiment 1 | B | Winding back is not done | 15% |

Figure 7:
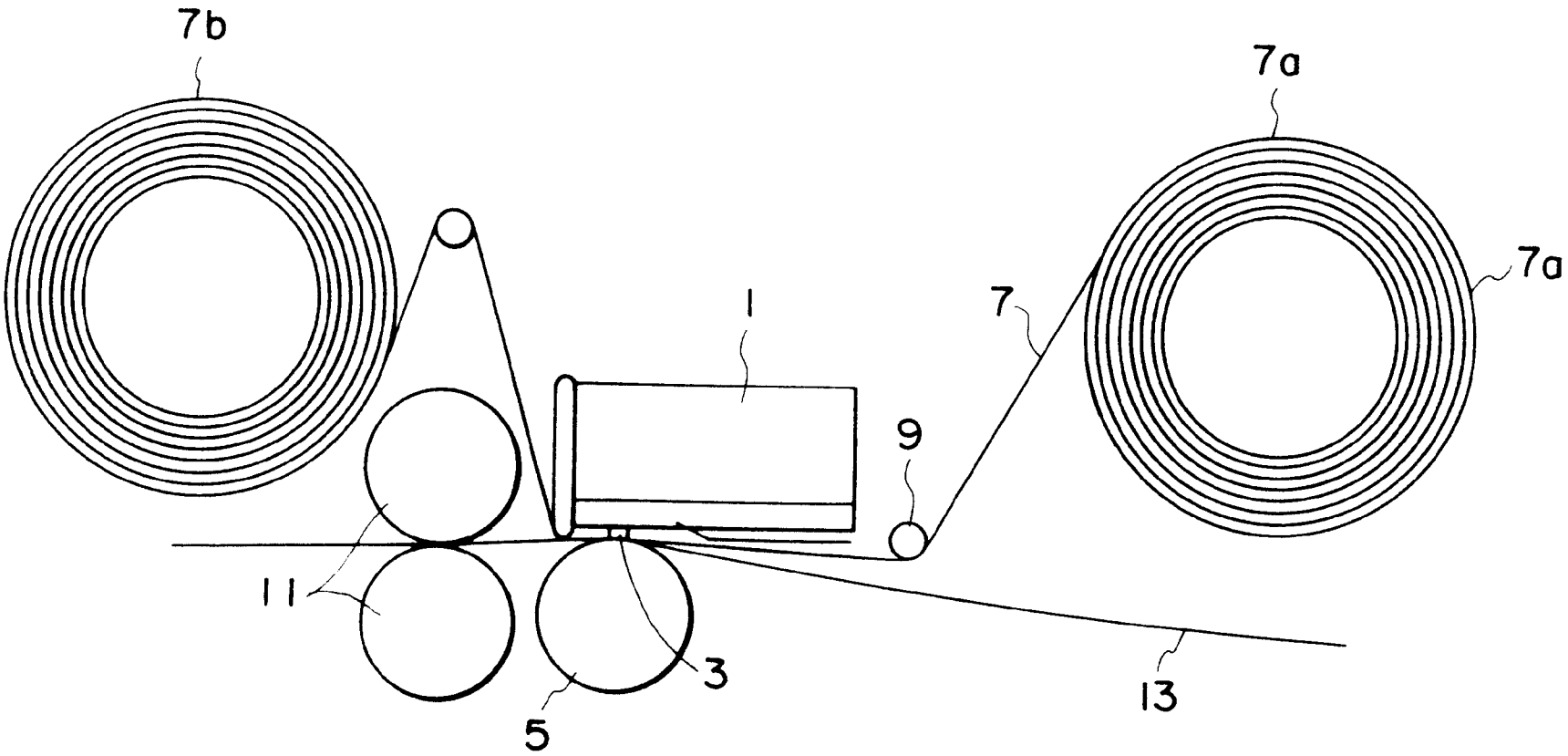
FIG. 7 is a schematic view of a conventional printer using the toner ribbon.

As evident from Table 1, in examples in which the cleaning roller according to the first, second or third embodiment was utilized as compared to the conventional construction shown in FIG. 7, the percentage of generation of line void dropped to 15%, 10% and 5% with respect to conventional 80%.

In a case in which the winding-back operation was carried out, in the first, second and third embodiments, the percentage of generation of line void further dropped to 5%, 2% and 1%.

Figure 8:
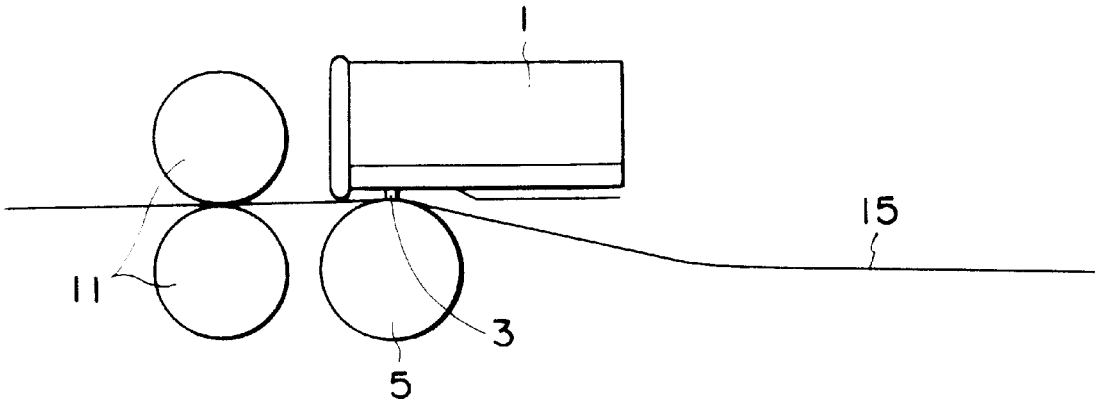
FIG. 8 is a schematic view of a conventional printer using a heat sensitive film.

In a case of direct thermal transfer upon the heat sensitive film 15, in an example using the cleaning roller according to the fourth embodiment as compared to the conventional construction shown in FIG. 8, the percentage of generation of line void dropped to 1% with respect to conventional 10%.

Although an example in which the line thermal head is applied as the thermal head has been described above with respect to the first, second, third and fourth embodiments, it is apparent that the cleaning roller of the present invention can be employed in examples in which a serial thermal head, laser recording head having a contact type glass exposing surface, LED recording head, liquid crystal display recording head, analog contact type exposing head or the like is employed as the thermal head 1.

In a case in which the line thermal head is used as well, this invention can be employed to heat sensitive materials other than shown in the embodiments. For example, they include color direct thermosensible paper such as thermo autochrome paper, manufactured by Fuji Photo Film Co., Ltd., color direct thermosensible film using film shaped supporting substance, ordinary direct thermosensible paper, fusion type thermal transfer paper, fusion type thermal transfer film, sublimation type thermal transfer paper, sublimation type thermal transfer film, and the like.

In the cleaning roller according to the present invention, as described in detail above, the adhesive roller is provided in an interval between the printing head and the feeding side for the recording material such that foreign matter adhering to the recording material is absorbed and removed by this adhesive roller. Thus, the surface of the recording material to be fed to the printing head can be kept always clean thereby preventing generation of line void which occurs because foreign matter is caught by the printing head.

Further, according to the operating method for the cleaning roller, a portion of the recording material which is located at the printing head prior to print is wound back up to a position beyond the adhesive roller and then that recording material is wound up by a larger amount than that of winding-back. Consequently, a recording material staying between the printing head and the adhesive roller is made to pass over the adhesive roller so that foreign matter adhering to the recording material between the printing head and the adhesive roller can be removed thereby making it possible to further reduce the percentage of generation of line void.

What is claimed is:

1. A cleaning roller system for cleaning a recording material comprising a ribbon and a recording sheet, said cleaning roller system comprising at least two adhesive rollers which are disposed on a recording material feeding side relative to a print head, said adhesive rollers have adhesive property and rotate in the direction of transporting said recording material; and wherein at least one of said adhesive rollers is disposed at either side of said ribbon so that a print head opposing surface of said ribbon is in contact with at least one of said adhesive rollers and a recording sheet opposing surface of said ribbon is in contact with another of said adhesive rollers.

2. A cleaning roller system according to claim 1, wherein at least one of said adhesive rollers is an adhesive guide roller disposed so as to guide the ribbon in a predetermined path.

3. A cleaning roller system according to claim 2, wherein at least one of said adhesive rollers is disposed so as to contact a thermal head opposing surface of said ribbon.

4. A cleaning roller system according to claim 3, wherein said adhesive rollers comprise rubber having tackiness which is provided on an external circumference of a shaft.

5. A cleaning roller system according to claim 3, wherein said adhesive rollers comprise adhesive tapes wound around a shaft.

6. A cleaning roller system according to claim 2, wherein said adhesive rollers comprise rubber having tackiness which is provided on an external circumference of a shaft.

7. A cleaning roller system according to claim 2, wherein said adhesive rollers comprise adhesive tapes wound around a shaft.

8. A cleaning roller system according to claim 1, comprising at least three adhesive rollers, and wherein said at least three adhesive rollers are disposed so as to contact the print head opposing surface of said ribbon, the recording sheet opposing surface of said ribbon, and a ribbon opposing surface of said recording sheet, respectively.

9. A cleaning roller system according to claim 5, wherein said adhesive rollers comprise rubber having tackiness which is provided on an external circumference of a shaft.

10. A cleaning roller system according to claim 8, wherein said adhesive rollers comprise adhesive tapes wound around a shaft.

11. A cleaning roller system according to claim 1, wherein said adhesive rollers comprise rubber having tackiness which is provided on an external circumference of a shaft.

12. A cleaning roller system according to claim 1, wherein said adhesive rollers comprise adhesive tapes wound around a shaft.

13. A cleaning roller system according to claim 1, wherein adhesion of at least one of said adhesive rollers is more than 1 $g/cm^2$ to less than 200 $g/cm^2$.

14. An operating method of a cleaning roller system which comprises adhesive rollers in contact with a surface of a recording material on a feeding side for said recording material relative to a print head, said operating method comprising the steps of:

winding back said recording material until a portion of said recording material opposing a print head passes said adhesive rollers prior to start of a print;

winding up said recording material by amount at least larger than that of winding back; and starting print with said print head in contact with said recording material.

15. An operating method of a cleaning roller system which comprises at least one adhesive roller in contact with a surface of a recording material on a feeding side for said recording material relative to a print head, said operating method comprising the steps of:

winding back said recording material until a portion of said recording material opposing a print head passes said at least one adhesive roller prior to start of a print;

winding up said recording material by amount at least larger than that of winding back; and starting print with said print head in contact with said recording material.

* * * * *